US005727816A

United States Patent [19]

Ong

[11] Patent Number: 5,727,816

[45] Date of Patent: Mar. 17, 1998

[54] STAPLED REPORT COVER

[76] Inventor: Bon S. Ong, P.O. Box 4247, Torrance, Calif. 90510

[21] Appl. No.: 692,910

[22] Filed: Jul. 15, 1996

[51] Int. Cl.[6] ..... B42D 3/00

[52] U.S. Cl. ..... 281/29; 281/21.1; 402/73

[58] Field of Search ..... 281/29, 21.1, 36, 281/37; 402/70, 73

[56] References Cited

U.S. PATENT DOCUMENTS

| | | | |
|---|---|---|---|
| 4,498,828 | 2/1985 | Ackerman | 281/29 |
| 4,928,995 | 5/1990 | Pickering et al. | 281/29 |
| 5,407,230 | 4/1995 | Brink et al. | 281/29 |
| 5,601,312 | 2/1997 | Funkhouser | 281/29 |

*Primary Examiner*—Willmon Fridie, Jr.
*Attorney, Agent, or Firm*—Charles H. Thomas

[57] ABSTRACT

A document cover of simple construction conceals and shields the fasteners that are customarily employed in binding a stack of pages of uniform size together along a binding margin. The document cover is formed of a plurality of panels including a broad top cover panel located atop the stack and residing in contact with the top sheet of the stack. The document cover also includes at least a narrow top concealment panel attached to either the top cover panel or the back panel by at least one spine fold. The top concealment panel extends from the binding edge of the stack of pages cross the binding margin of the stack. The document cover includes at least a single layer of adhesive secured to the stack so that the top concealment panel conceals the fasteners from view from the top of the stack of pages. Preferably, one or more additional layers of adhesive are provided in the structure to similarly conceal and shield the opposite sides of the fasteners from contact and from view when the document is opened from the back. In some embodiments the document cover of the invention is formed from a single sheet of opaque material, while in other embodiments the document cover is formed of a plurality of sheets, at least one of which is transparent and the other of which is opaque.

19 Claims, 8 Drawing Sheets

STAPLED REPORT COVER

BACKGROUND OF THE INVENTION

1. Field of the Invention

The present invention relates to covers for documents formed of stacks of pages secured together along a single edge.

2. Description of the Prior Art

At present covers are often highly desirable for protecting stacks of papers that are bound together along a single edge. Documents such as reports, promotional presentations, and sales proposals are often bound in this manner. Covers preserve the appearance of the pages within a report or other document by preventing the sheets of paper within the stacks from becoming wrinkled or soiled during transportation, storage, or during use. A variety of different types of report covers have been devised, but all conventional types of such covers entail certain disadvantages or drawbacks.

For example, one type of document report cover involves the use of front and back panels of material stiffer than the sheets of paper contained within the cover. Staples or other fasteners are inserted into and extend entirely through the structure of not only the pages within the report, but also the front and back panels as well. Such fasteners may include wire staples; individual button-headed, pronged fasteners; or alternatively an elongated pronged metal or plastic fastener having an apertured metal or plastic compressor strip through which the prongs of the fastener extend. In the latter type of fastener the prongs are folded over toward each other onto the surface of the compressor strip where they are held in place by retainers that slide along the length of the compressor strip to capture the prongs therebeneath. While all such fasteners are quite effective in holding the pages of a document together between front and back panels of a report cover, they are unsightly and can scratch the finish of a desk, snag clothing, and even cause minor but painful injuries to persons handling the report.

To remedy the deficiencies of such systems, a report is sometimes provided with a shield that extends along the bound edge of the document and which encases the metal or plastic fasteners within its grasp. The shield may take the form of a flexible cloth or plastic binding that frictionally or adhesively grips the bound marginal edges of the report cover panels to thereby encase the fasteners therewithin. However, while effective for the purpose of concealing the rigid fastening members, such shields add considerably to the expense of the report cover. Moreover, depending upon the material of which they are constructed, they also create a significant additional thickness to the binding margin of the report. This prevents a number of reports from being neatly stacked one atop another, since with each successive report in a vertical pile, the bound marginal edge of the uppermost report is elevated further by the additional thickness of each succeeding shielding member. As a result the uppermost of such a pile of reports will tend to slide off of a desk onto the floor.

Another type of report cover system involves a folder which is provided with outer front and back panels and narrow mounting strips located between these panels. One of the mounting stirps may contain a plurality of sets of prongs while the other mounting strip contains apertures aligned with the sets of prongs. However, this system requires all of the paper sheets in a report to be uniformly punched and then strung onto the prongs. The sets of prongs must then be manipulated through the apertures in the other strip. The prongs in each pair are then spread apart from each other so as to clamp the papers in the report between the mounting strips.

While such a system does envelope the metal fasteners within an outer cover, shielding them from view and thereby preventing the fasteners from scratching desks or snagging upon clothing or other fabrics when the report is closed, once the report cover is opened, the mounting prongs present an unsightly appearance. Furthermore, the pages of the report must always be punched before they can be mounted on the mounting strips. Moreover, it is often somewhat difficult to manipulate the pages of the report onto the sets of prongs, and thereafter manipulate the sets of prongs through the apertures provided to receive them. This is particularly true in the case of reports that are relatively thick, since the distance between the mounting strips cannot be altered. Thus, the process of mounting the document within the report cover is both arduous and inconvenient.

SUMMARY OF THE INVENTION

It is an object of the present invention to provide a report cover which is both inexpensive to produce and very easy to utilize. The system of the invention allows a plurality of pages to be arranged in a stack and securely fastened along a single edge utilizing one or more strong, durable fasteners while shielding the fasteners from view and external contact. Individual button-headed, pronged fasteners or a single pronged fastener comprised of a base having projecting prongs and a compressor having apertures to receive the prongs may be utilized as the fastening members or member. However, it is much simpler and easier to fasten a plurality of stacked pages together along a binding margin using several wire staples.

One primary object of the invention is to provide a report cover in which the fastening mechanisms are concealed from view even when the cover is open. This is possible only due to the unique construction of the report cover of the invention, and the manner in which it is attached to the pages of the report. Unlike prior report cover systems, in the combination of elements according to the invention the staples are shielded from external contact and also from view, at least from the top of the report, and more typically from both the top and bottom of the report. The metal fasteners do not project through the enveloping structure of the report cover. To the contrary, they are encompassed within the confines of the report cover of the invention, even when the report is opened.

Another important object of the invention is to provide a report cover arrangement that allows sheets of paper secured along a binding margin, such as by staples, to be housed within a report cover without requiring the sheets to be punched to receive either metal prongs or metal fastening rings. Thus, a stack of pages may be readily bound within the report cover of the invention without the necessity for prepunching the pages to be bound.

Still a further object of the invention is to provide a report cover which is extremely simple in construction and which can be manufactured with great economy. The report cover of the invention can be manufactured from a single sheet of stock if desired. Alternatively, it can be manufactured from two or even more sheets of material if it is desired to create a report cover in which the front cover is structurally different from the back. For example, it is often desirable for the top cover panel of a report cover to be transparent so that the title page of the report can be read clearly from the top of the report through a transparent front cover panel. The front panel may be formed of a transparent, soft, sheet-like material, such as Mylar® plastic. On the other hand, it may be desirable for the back panel to be formed of a stiffer, contrasting material, such as heavy, brightly colored card stock. According to the system of the invention each of these different arrangements is possible utilizing the unique report cover construction and system of attachment of the report cover to the pages of the document contained therewithin.

In one broad aspect the present invention may be considered to be a combination of a plurality of pages disposed one atop another to form a stack with top and bottom sheets and defining a binding edge of the stack, an opposite edge of the stack parallel to the binding edge, and a narrow binding margin on the stack adjacent the binding edge. The combination of the invention also includes a document cover formed of a plurality of panels including a broad top cover panel located atop the stack and extending entirely across the stack from at least the binding margin and reaching the opposite edge. The document cover also includes at least one concealment panel attached to the top cover panel atop the narrow binding margin of the stack and extending across the binding margin to the binding edge. The document cover also includes a broad back panel joined to the concealment panel by at least one spine fold adjacent the binding edge so as to extend beneath the stack and so as to reach the opposite edge. The combination also includes at least one fastener passing through and emerging from the top and bottom sheets at the binding margin of the stack, and at least one layer of adhesive interposed between the document cover and the narrow binding margin of the stack to thereby conceal the fastener from view where it emerges from at least the top sheet.

In one preferred embodiment of the invention the document cover is formed of a single sheet of planar stack, such as card stock, and the broad top cover panel resides in contact with the binding margin and extends all the way to the binding edge of the stack. In this arrangement an adhesive layer adhesively bonds the top cover panel directly to the concealment panel, which may be hinged by a spine fold either directly to the back panel or, for a thicker report, through a pair of spine folds that define an outer spine panel therebetween. In this arrangement the spine panel is interposed between the top concealment panel and the back panel and is joined therebetween in articulated fashion. Also, a second layer of adhesive is preferably interposed between the portion of the back panel juxtaposed against the bottom sheet at the binding margin of the stack. The adhesive bond between the narrow region of the back panel adjacent the binding edge of the stack and the bottom sheet of the stack at the binding margin thereof thereby obscures the fastener from view at the back of the report, as well as from the top.

In another preferred embodiment of the invention in which the document cover is formed from two different sheets of stock, the marginal region of the top cover panel that overlies the binding margin of the stack of papers may be secured directly to the pages in the stack by the wire staples that are employed to fasten the sheets of papers in the document to each other. This is possible while still concealing the staples from the top if the concealment panel is formed as an extension of the back panel that is folded up over the binding edge of the stack of papers so as to overlie the marginal portion of the top cover panel that resides in contact with the binding margin of the stack of papers. The underside of the concealment panel is thereby secured directly to the upwardly facing marginal region of the top cover panel that overlies the binding margin of the stack of papers along the length thereof. The staples are thereby concealed from view and from any external contact from above by the narrow, concealment panel. In those embodiments in which a single layer of adhesive is employed, the adhesive layer may adhesively bond the top cover panel directly to the concealment panel.

Preferably also a second layer of adhesive is interposed between the bottom sheet of the stack and the interior surface of the back panel beneath the binding margin of the stack to conceal the staples from the bottom side as well. In such an arrangement the top cover panel of the document cover and the pages of the document are securely attached to each other by staples. Nevertheless, the staples are totally concealed from view and from contact with any external structure or material by the sheet of stock that is folded over to form the concealment panel and back panel and by the two strips of adhesive that secure the concealment panel atop the top cover panel and the back panel to the underside of the stack of papers. In this arrangement the top cover panel is typically formed of a transparent plastic sheet and the back panel and the concealment panel are both formed as articulated portions of a single, separate, opaque sheet of stiff paper or card stock.

In alternative constructions the document cover may be formed of a single sheet of stock, preferably of stiff paper. In one arrangement utilizing a single sheet of stock for the construction of the document cover, a return panel, a spine panel, or both are located in articulated fashion between the concealment panel and back panel.

The invention may be described with greater clarity and particularity by reference to the accompanying drawings.

DESCRIPTION OF THE EMBODIMENTS

Figure 1:
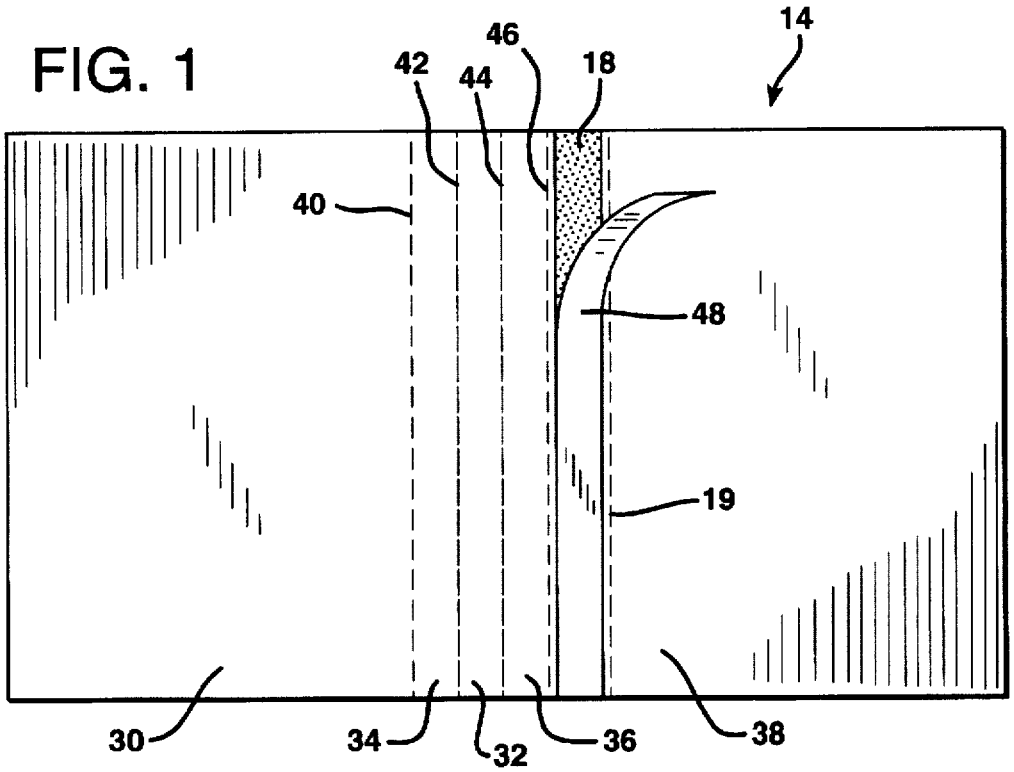
FIG. 1 is a top plan view illustrating a single sheet of stiff paper stock that is utilized to form one embodiment of the invention.

FIGS. 1–5 illustrate one preferred embodiment of the invention indicated generally at 10. This embodiment of the invention is formed of the combination of a plurality of rectangular paper pages, typically having dimensions of eight and one-half by eleven inches in this country, disposed one atop another to form a stack 12. The combination of the invention also includes a report cover indicated at 14, a plurality of fasteners in the form of wire staples 16, and a single narrow layer of adhesive 18.

The stack 12 includes a plurality of sheets of paper disposed one atop another. The uppermost or top sheet 20 lies at the top of the stack 12, while the lowermost or bottom sheet 22 lies at the bottom of the stack 12. The stack 12 also defines a binding edge 24 and an opposite edge 26. While the paper stack 12 may be bound at the top, more typically it is bound along the left side as illustrated. The opposite edge 26 is parallel to the binding edge 24. The stack 12 also defines a narrow binding margin 28, adjacent to the binding edge 24. The binding margin 28 represents only a narrow portion of the width of the sheets of paper in the stack 12, and is typically no greater than about one inch in width.

The report cover 14 is fabricated from a single sheet of flat, card-paper stock and is formed of a plurality of different panels joined together in articulated fashion. Specifically, the report cover 14 includes a broad top cover panel 30, a narrow concealment panel 32 that is joined to the top cover panel 30 through folded connections with an intervening, narrow articulated return panel 34. The report cover 14 also includes a narrow spine panel 36 and a back panel 38. The panels 30, 32, 34, and 36 are all of rectangular configuration and are joined to each other in articulated fashion by fold lines that are mutually parallel to each other and to the binding edge 24 and the opposite edge 26 of the stack 12.

In the finished combination forming the report 10 the broad top cover panel 30 is located atop the stack 12 and resides in contact with the top sheet 20 and with the binding margin 28 of the stack 12. The top cover panel 30 extends entirely across the width of the stack 12 from the binding edge 24 and reaches and extends beyond the opposite edge 26 of the stack 12. The return panel 34 is located in an articulated fashion between the concealment panel 32 and the top cover panel 30. The return panel 34 is joined to the top cover panel 30 by a linear fold 40 that is located above and extends parallel to the binding edge 24 of the stack 12. The return panel 34 is folded back above and across the marginal region of the top cover panel 30 that lies atop the binding margin 28 of the stack 12.

Figure 2:
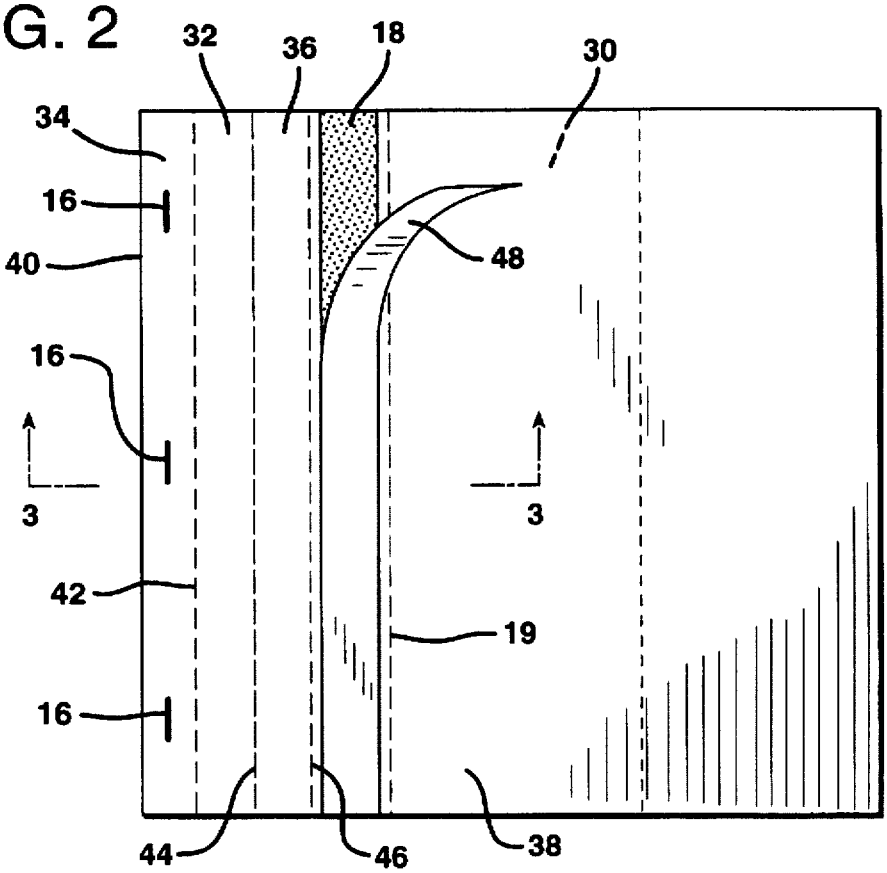
FIG. 2 is a top plan view illustrating the use of the report cover stock of FIG. 1 in an intermediate step in assembling a bound report according to the invention.
Figure 3:
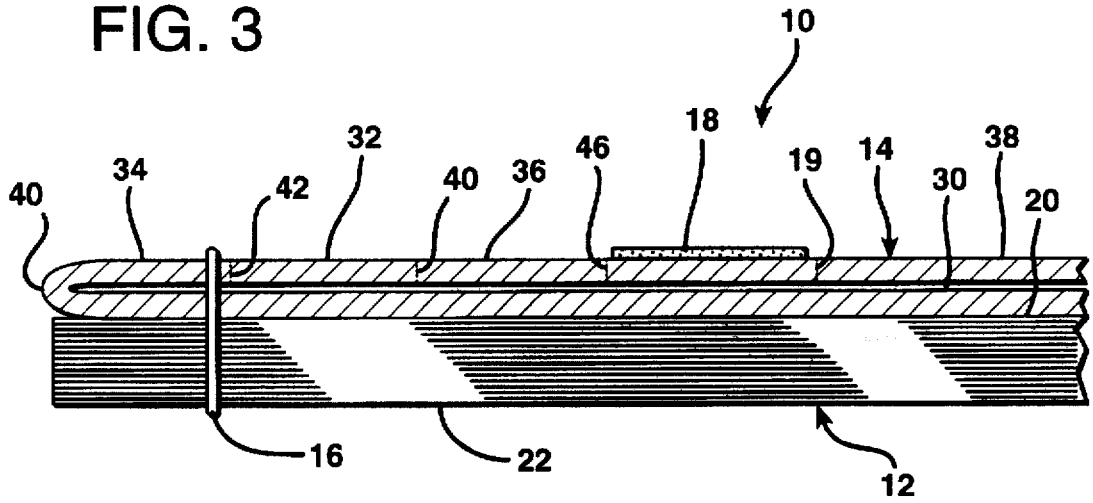
FIG. 3 is a sectional elevational detail taken along the lines 3—3 of FIG. 2.

The report 10 is illustrated during an intermediate stage of assembly in FIGS. 2 and 3. As shown in those drawing figures, once the return panel 34 has been folded back across the top cover panel 30 by creasing the fold 40, all of the wire staples 16 are fastened so as to extend entirely through the binding margin 28 of the stack 12, the top cover panel 30 at the locations located directly thereabove, and vertically aligned locations in the return panel 34. The staples are inserted using a conventional mechanical stapler.

With the report cover 14 folded at the fold line 40 as depicted if FIGS. 2 and 3, the stapler is positioned to the left of the stack 12. The stapler is aligned in an orientation perpendicular to the binding edge 24 of the stack 12 such that the staple arm of the stapler resides above the stack 12 and also above the top cover panel 30 and the return panel 34. The anvil of the stapler resides beneath the bottom sheet 22 of the stack 12 beneath the binding margin 28 of the stack 12. The staple arm can then be depressed in a conventional manner so as to drive the staples 16 through the return panel 34, the top cover panel 30, and the entire paper stack 12.

Figure 5:
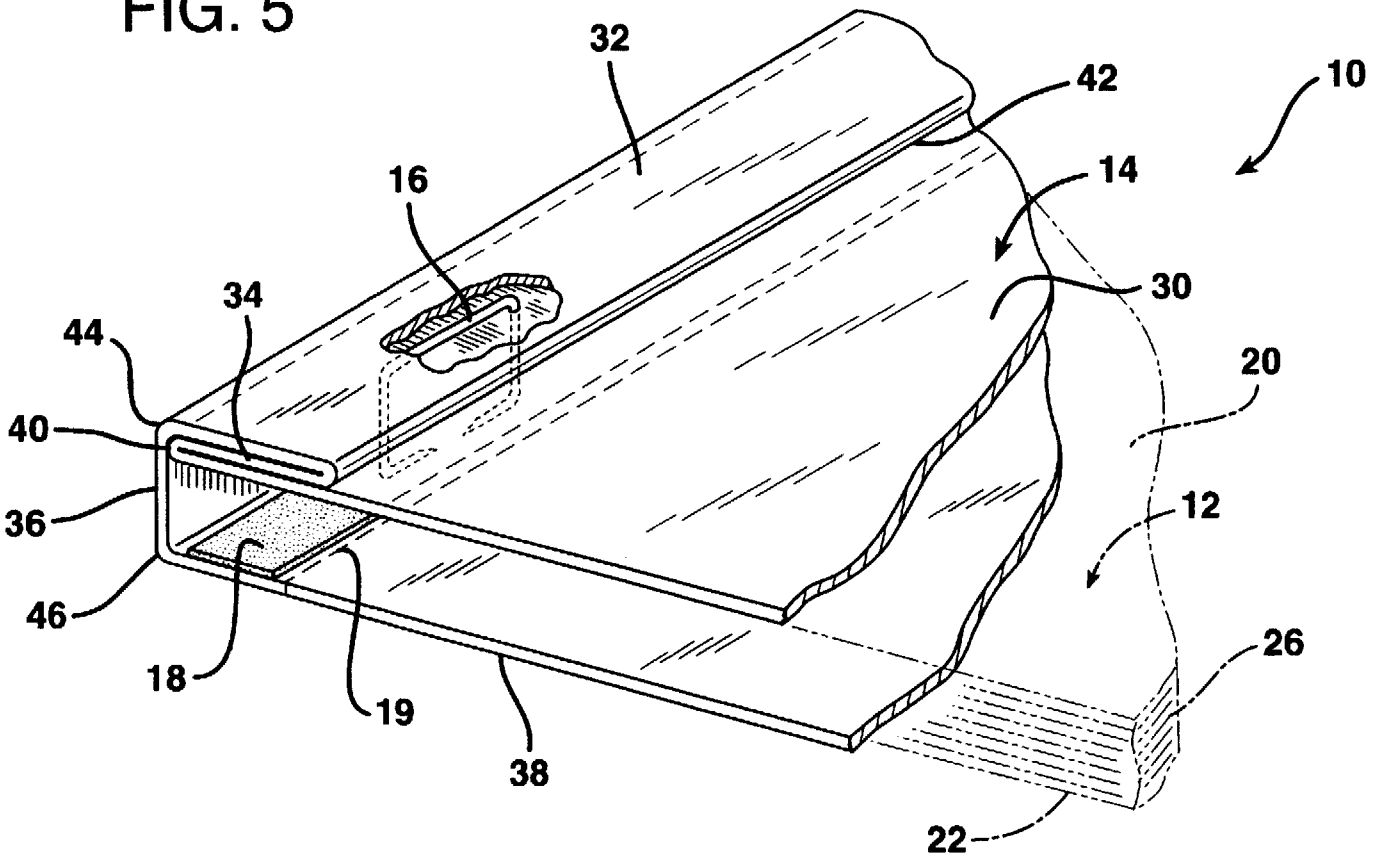
FIG. 5 is a perspective detail illustrating a portion of the bound report of FIG. 4.

As illustrated in FIGS. 2, 3, and 5, the staples 16 pass through and emerge from both the top sheet 20 and the bottom sheet 22 of the stack 12 within the binding margin 28 of the stack 12 and also through the return panel 34 and through the top cover panel 30 where it contacts the binding margin 28 of the stack 12. The feet of the wire staples emerge from and are bent underneath the bottom sheet 22 in the stack 12.

Typically two and preferably three staples are inserted through the structure of the report cover 14 and the stack 12 in the manner depicted in FIGS. 2, 3, and 5. At this point the concealment panel 32 is then folded back atop the return panel 34 along a linear fold line 42 that is parallel to the binding edge 24 and which is located at the extremity of the binding margin 28 closest to the opposite edge 26 of the stack 12. The concealment panel 32 thereby extends back across the binding margin 28 from the fold line 42 to a location at or slightly beyond alignment with the binding edge 24.

For thin reports no spine panel is required, and the spine panel 36 need not necessarily be folded relative to the back panel 38 or even defined on the report cover 14. However, for a thicker stack 12, such as the stack illustrated in FIGS. 1–5, the spine panel 36 is folded down from the concealment panel 32 along the spine fold line 44. The spine panel 36 thereby extends in a plane proximate to and parallel to the binding edge 24 of the stack 12. The back cover panel 38 is then folded underneath the stack 12 along the fold line 46.

Atop the back cover panel 38 in the region thereof that resides directly beneath the binding margin 28 of the stack 12 there is a narrow, elongated layer of pressure-sensitive adhesive 18. The layer of adhesive 18 is interposed between the bottom sheet 22 of the stack 12 and the marginal area of the back cover panel 38 adjacent the fold line 46. A fold line 19 in the back panel 38 adjacent the binding margin 28 and the adhesive layer 18 serves to avoid stress on the adhesive layer 18.

Figure 4:
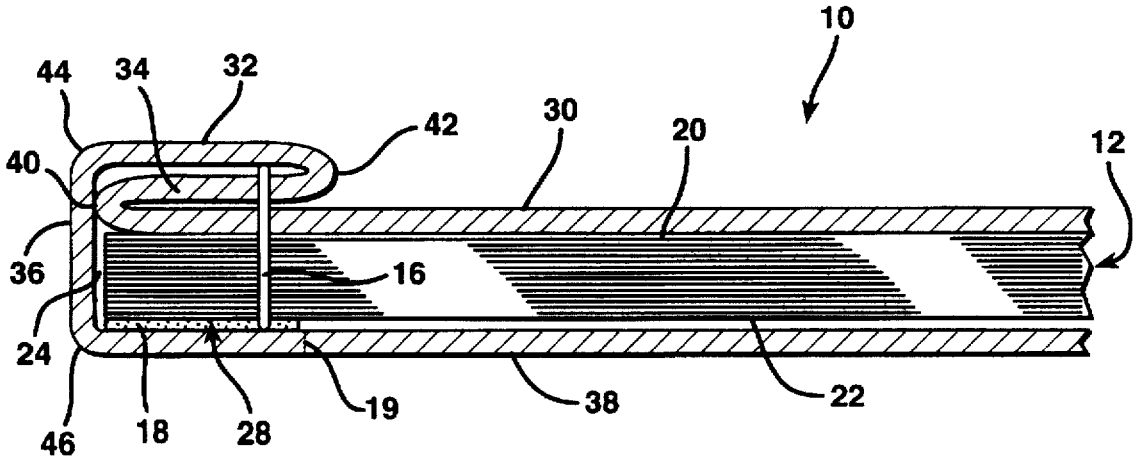
FIG. 4 is a sectional elevational detail view of the finished report of the embodiments of FIGS. 1–3.

The adhesive layer 18 is initially covered with a paper strip 48 coated with a release agent that prevents the adhesive layer 18 from bonding to any structure until the report 10 is assembled. Once the return panel 34 has been folded back across the top cover panel 30, the release strip 48 should be removed, as illustrated in FIG. 2, thereby exposing the adhesive layer 18. The concealment panel 32 is then folded in a reverse fashion back across the return panel 34 and the spine panel 36 folded downwardly from the concealment panel 32. As the concealment panel 32 and the spine panel 36 are folded back as illustrated in FIG. 4, the back cover panel 38 is brought into an orientation parallel to the top cover panel 30 such that the adhesive layer 18 establishes contact with the bottom sheet 22 at the binding margin 28 of the stack 12. With a compressive force applied between the concealment panel 32 and the back cover panel 38 at the binding margin 28, the adhesive layer 18 becomes firmly bonded to the stack 12 along the length of the binding margin 28 by virtue of its attachment to the marginal area of the bottom sheet 22.

As is most clearly evident in FIG. 4, the staples 16 are at this time totally concealed from view. The concealment panel 32 totally shields and conceals from view the back of the staples 16, while the portion of the back cover panel 38 that is adhesively secured to the bottom sheet 22 shields and obscures from view the crimped staple feet. It is therefore evident that the staples 16 are not only totally visually concealed, but are also physically shielded so that they cannot scratch the surface of a desk or snag on clothing or other cloth material.

Figure 6:
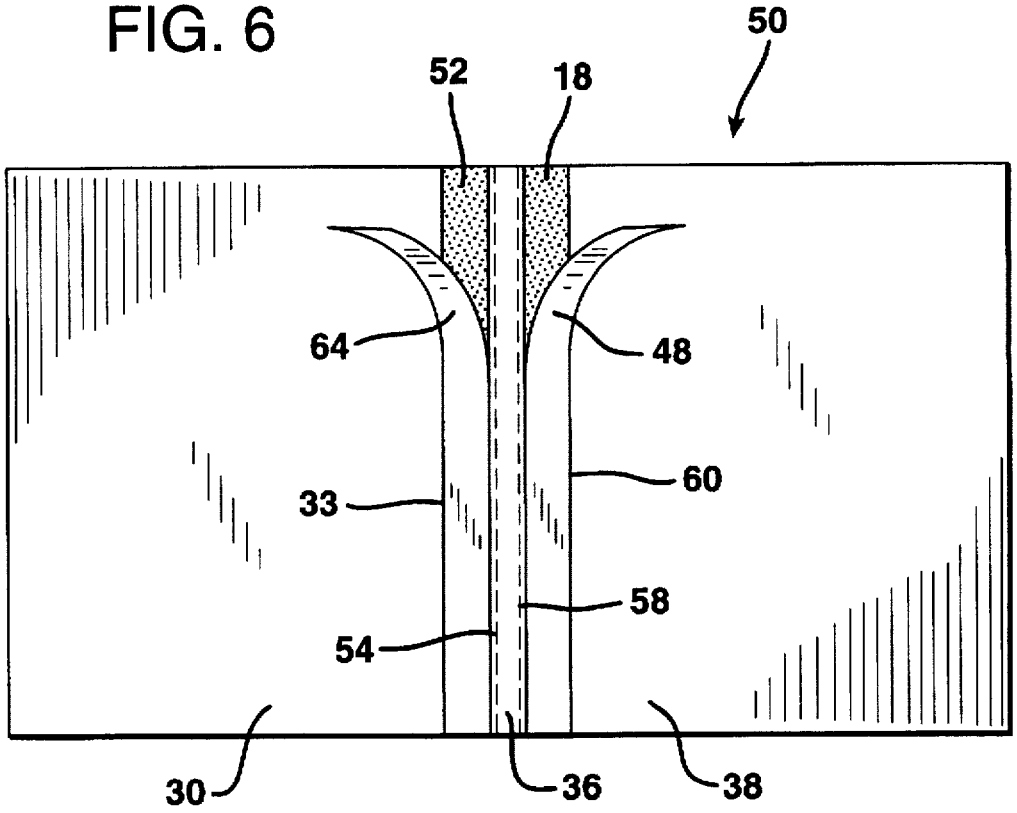
FIG. 6 is a top plan view illustrating another single sheet of material stock suitable for forming a different embodiment according to the invention.
Figure 7:
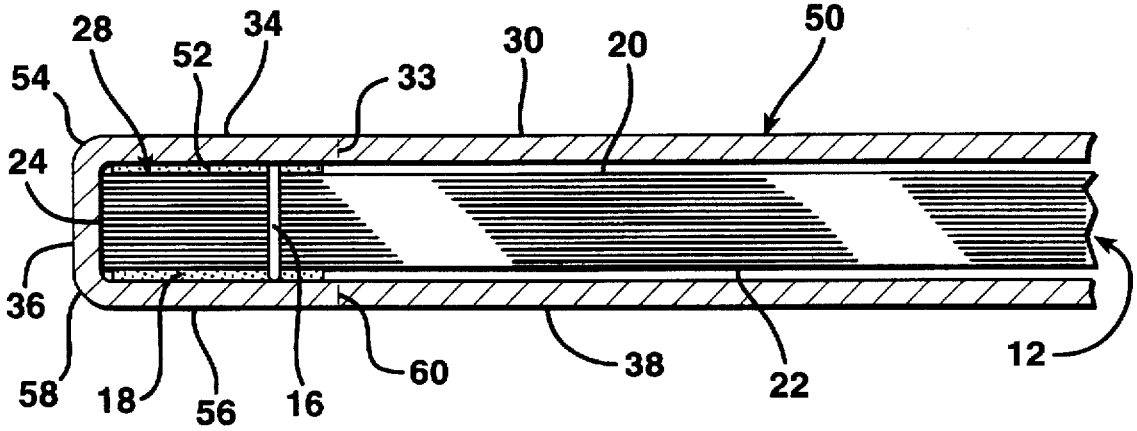
FIG. 7 is a sectional elevational detail illustrating an embodiment of the invention formed with the report cover shown in FIG. 6.

The report combination 10 illustrated in FIGS. 1–5 illustrates one system in which but a single sheet of material stock is employed in the formation of the report cover 14 and in which but a single layer of adhesive 18 is necessary to totally conceal the staples 16. FIGS. 6 and 7 illustrate an alternative embodiment of the invention which also employs a single sheet of stiff paper card stock to form a report cover 50, but which also employs a second narrow adhesive layer 52 in addition to the first adhesive layer 18. The report cover 50 may be utilized to bind the same paper stack 12 depicted in FIGS. 1 through 5.

Like the report cover 14, the report cover 50 includes a broad top cover panel 30, a top concealment panel 34, a spine panel 36, and a broad back panel 38. As best shown in FIG. 7, the top cover panel 30 extends across the stack 12 from the binding margin 28 and reaches the opposite edge 26 of the stack 12. Unlike the embodiment of FIGS. 1–5, the top cover panel 30 does not extend all the way to the binding edge 24 of the stack 12. Instead, the top concealment panel 34 is attached directly to the top cover panel 30 at a demarcation fold line 33 where the top cover panel 30 terminates at the binding margin 28. The concealment panel 34 extends across the narrow binding margin 28 to the binding edge 24 of the stack 12. As in the embodiment of FIGS. 1–5, the spine panel 36 extends parallel to the binding edge 24 of the stack 12 beyond the top sheet 20 and the bottom sheet 22. However, in the embodiments of FIGS. 6 and 7 there is no return panel. Consequently, the spine panel 36 is attached to the extreme terminal edge of the top concealment panel 34 and is delineated therefrom by a right-angle fold 54.

At the bottom of the stack 12 the spine panel 36 is connected to a second, narrow, bottom concealment panel 56. The bottom concealment panel 56, like the top concealment panel 34, extends across the narrow binding margin 28 of the stack 12, but on the underside thereof. The bottom concealment panel 56 is attached to the spine panel 36 and is delineated therefrom by a right-angle fold 58 at the binding edge 24 of the stack 12. The bottom concealment panel 56 is connected to the back cover panel 38 at a crease line 60 in the card stock forming the report cover 50. The top cover panel 30, the top concealment panel 34, the spine panel 36, the bottom concealment panel 56, and the back cover panel 38 are thereby attached to each other in an articulated manner by the crease lines and folds indicated in FIG. 7.

In the embodiment of FIGS. 6 and 7, the first pressure-sensitive adhesive layer 18 is coated onto the bottom concealment panel 56 while the second pressure-sensitive adhesive layer 52 is coated onto the top concealment panel 34. Initially, both the bottom and top adhesive layers 18 and 52 are respectively covered by narrow paper strips 48 and 64 that are coated on their undersides with a release agent so that they may be pulled free of the top and bottom adhesive layers 18 and 52. The report covers 50 may thereby be stored and shipped one atop another without sticking to each other.

When the paper stack 12 is to be bound within the report cover 50, the stack 12 is stapled together by three staples 16. Unlike the system depicted in FIGS. 1–5, however, the backs of the center regions of the staples 16 reside directly in contact with the top sheet 20 in the stack 12, as the staples 16 are inserted before the report cover 50 is attached to the stack 12. In this embodiment the stapes 16 do not penetrate the top cover panel 30. As in the embodiment of FIGS. 1–5, the legs of the staples 16 penetrate through and are bent under the bottom sheet 22 in the stack 12 in the binding margin 28 of the stack 12. All of the papers in the stack 12 are then secured to each other by the staples 16, but the staples 16 do not directly secure the stack 12 to the report cover 50.

To the contrary, with the report cover 50 laid facing upwardly as depicted in FIG. 6, the release strips 48 and 64 are respectively pulled free from the adhesive layers 18 and 52. The stack 12 is then carefully positioned above the back cover panel 38 and the bottom concealment panel 56 and pressed downwardly into contact therewith such that the binding edge 24 of the stack 12 is aligned with the fold line 58 between the bottom concealment panel 56 and the spine panel 36. The spine panel 36 may be bent upwardly into right-angle alignment relative to the bottom concealment panel 56 to facilitate placement of the stack 12 in this regard.

The top concealment panel 34, together with the top cover panel 30 are then folded over the top sheet 20 of the stack 12 with the fold 54 between the spine panel 36 and the top concealment panel 34 in alignment with the binding edge 24 of the stack 12, as illustrated in FIG. 7. Pressure is then exerted between the top concealment panel 34 and the bottom concealment panel 56 throughout the length and width of the binding margin 28 of the stack 12. The top adhesive layer 52 firmly bonds to the top sheet 20 of the stack 12 at the binding margin 28 thereof. Concurrently, the pressure causes the bottom adhesive layer 18 to firmly bond the bottom concealment panel 56 to the bottom sheet 22 of the stack 12 throughout the length and width of the binding margin 28.

The top cover panel 30 can thereupon be lifted up away from the portion of the top sheet 20 extending from the binding margin 28 to the edge 26 opposite the binding edge 24 by folding the top cover panel 30 upwardly and back over the top concealment panel 34 along the crease 33. Similarly, the back cover panel 38 can be lifted away from the portion of the bottom sheet 22 extending from the binding margin 28 to the edge 26 of the stack 12. It should be noted, however, that even when the top cover panel 30 and the back cover panel 38 are folded away from the stack 12, the concealment panels 34 and 56 remain in mutually parallel alignment to each other, firmly secured to the top and bottom of the binding margin 28 of the stack 12, and totally concealing the staples 16 from view and from contact with any external structure.

Figure 8:
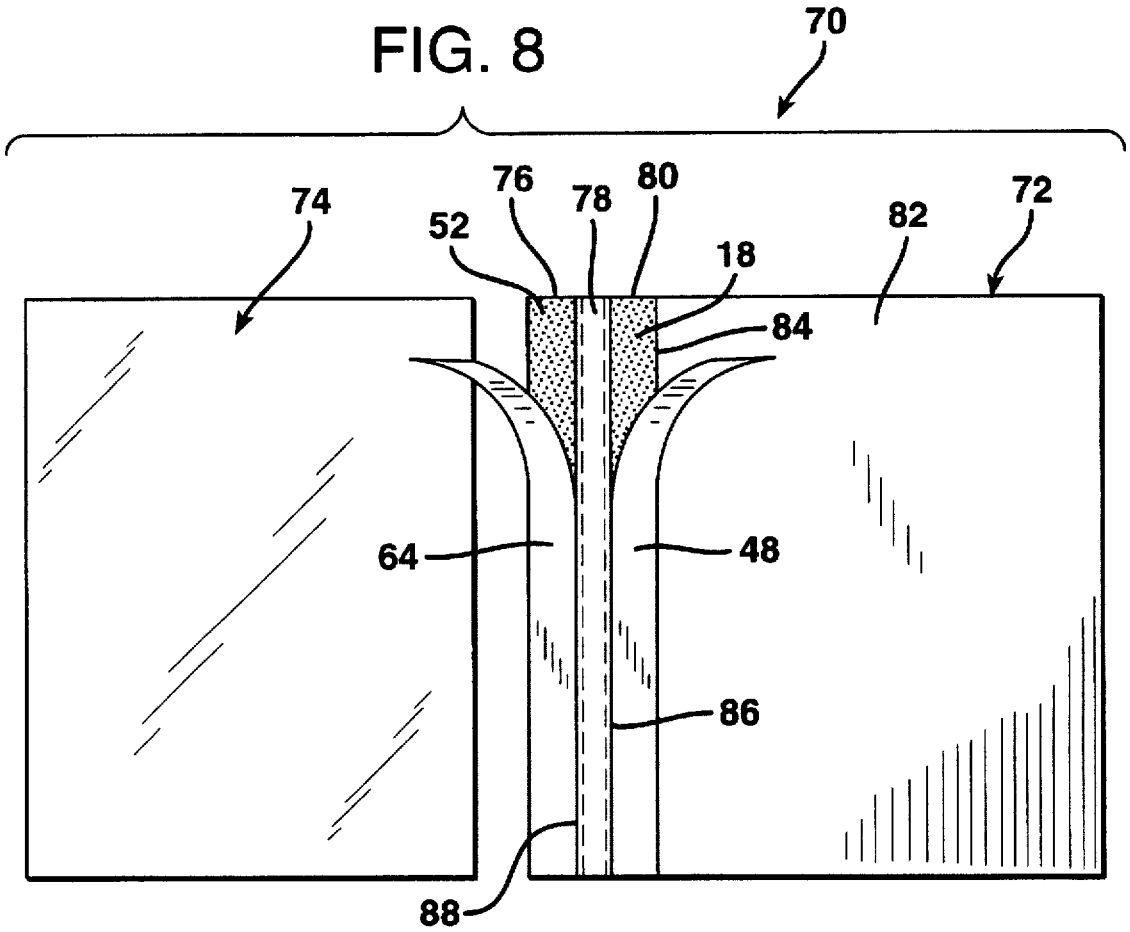
FIG. 8 is a top plan view illustrating two sheets of stock used to form a report cover for a different embodiment of the invention.
Figure 10:
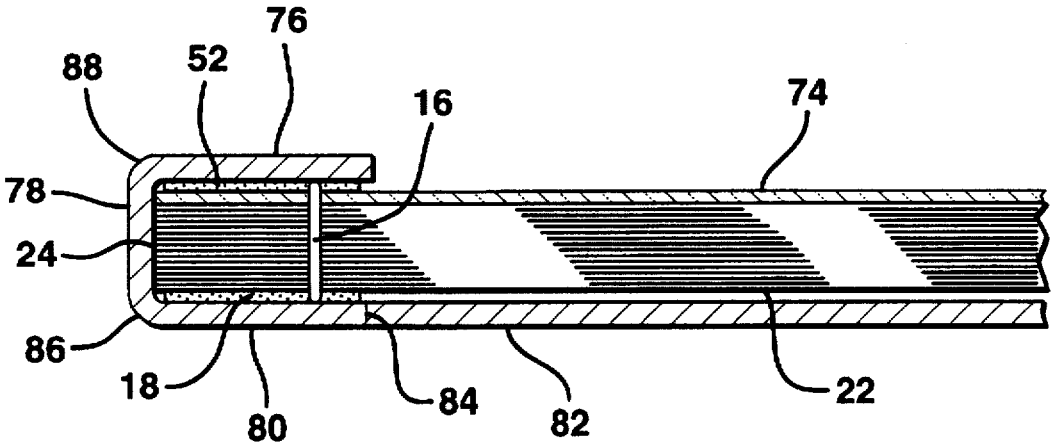
FIG. 10 is a sectional elevational detail of the finished report cover of FIG. 9.
Figure 9:
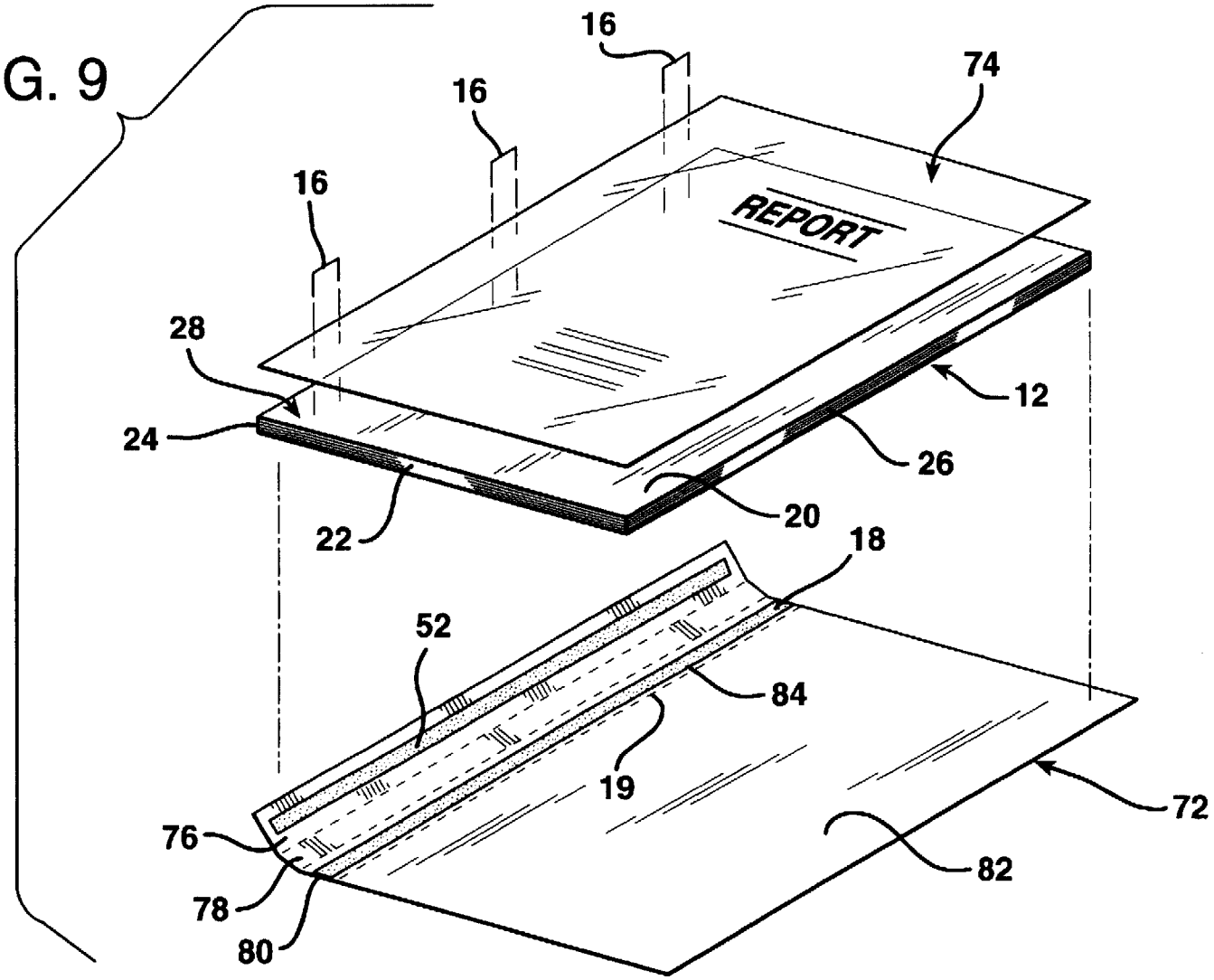
FIG. 9 is an exploded perspective view illustrating assembly of a report according to the invention utilizing the report cover of FIG. 8.

FIGS. 8, 9, and 10 illustrate a further alternative embodiment of the invention. A report cover 70 is utilized to bind a stack 12 of papers of uniform length and width piled one atop another, as in the other embodiments. The report cover 70 is formed from a plurality of rectangular sheets of planar stock, namely a sheet of opaque card stock 72 and a transparent sheet 74 formed of a flexible, plastic material, such as Mylar® plastic. The sheet 74 serves as a transparent top cover panel. The card stock sheet 72 forms a top concealment panel 76, a spine panel 78, a bottom concealment panel 80, and a back cover panel 82.

The bottom concealment panel 80 is joined to the bottom cover panel 82 by a crease 84 that allows the bottom cover panel 82 to be folded away from coplanar alignment with the bottom concealment panel 80 and out of contact with the bottom page 22 of the stack 12. The bottom concealment panel 80 is joined to the spine panel 78 by a right-angle fold 86 at the binding edge 24 of the stack 12. The sheet 72 is folded back over away from the spine panel 78 by another right-angle fold 88 to delineate the top concealment panel 76 that extends toward the opposite edge 26 of the stack 12 a short distance just sufficient to cover the binding margin 28 of the stack 12. The concealment panels 76 and 80 thereby reside in mutually parallel alignment with each other respectively located atop and beneath the binding margin 28 of the stack 12.

To assemble the combination depicted in FIG. 9, the top cover panel 74 is placed directly atop the top sheet 20 in the stack 12 of papers so as to extend from at least the binding edge 24 thereof to beyond the opposite edge 26. Three staples 16 are then applied using a conventional stapler so that the backs of the staples 16 reside atop and in contact with the upper, outwardly facing surface of the top cover panel 74 and so that the staple legs extend downwardly through the entire thickness of the stack 12 and are folded under the bottom sheet 22 thereof in the binding margin 28, as illustrated in FIGS. 9 and 10.

The card stock sheet 72 is provided with a lower or bottom adhesive layer 18 and a top adhesive layer 52, as in the embodiment of FIGS. 6 and 7. These layers, as in the embodiment of FIGS. 7 and 7, are likewise respectively covered with strips 48 and 64 coated with a release agent. When the report of FIG. 9 is to be assembled, the release agent coated strips 48 and 64 are peeled away from the bottom adhesive layer 18 and the top adhesive layer 52, respectively, as illustrated in FIG. 8. The stack 12 to which the top cover panel 74 has already been stapled is then located directly above the bottom cover panel 82 and the bottom concealment panel 80 and lowered into contact therewith so that the binding edge 24 of the stack 12 is immediately adjacent to the spine panel 78. To assist in placement of the stack 12 the spine panel 78 may be bent upwardly along the fold 86, as illustrated in FIG. 9.

Once the bottom sheet 22 of the stack 12 has contacted the bottom adhesive layer 18, pressure is exerted on the binding margin 28 so that the bottom concealment panel 80 is adhesively secured thereto throughout the length and width of the binding margin 28 at the underside of the stack 12. The spine panel 78 is then folded completely upwardly to reside at right angles relative to the bottom concealment panel 80, and the top concealment panel 76 is then folded over on top of the region of the top cover panel 74 that resides directly atop the binding margin 28 of the stack 12 at the upper surface thereof. With the application of pressure the top concealment panel 76 is thereupon firmly secured to the portion of the top cover panel 74 residing directly therebeneath throughout the length and width of the binding margin 28 of the stack 12. As a result, the top and bottom concealment panels 76 and 80 totally cover the staples 16 and shield them from view as well as from contact with any external structure.

Figure 11:
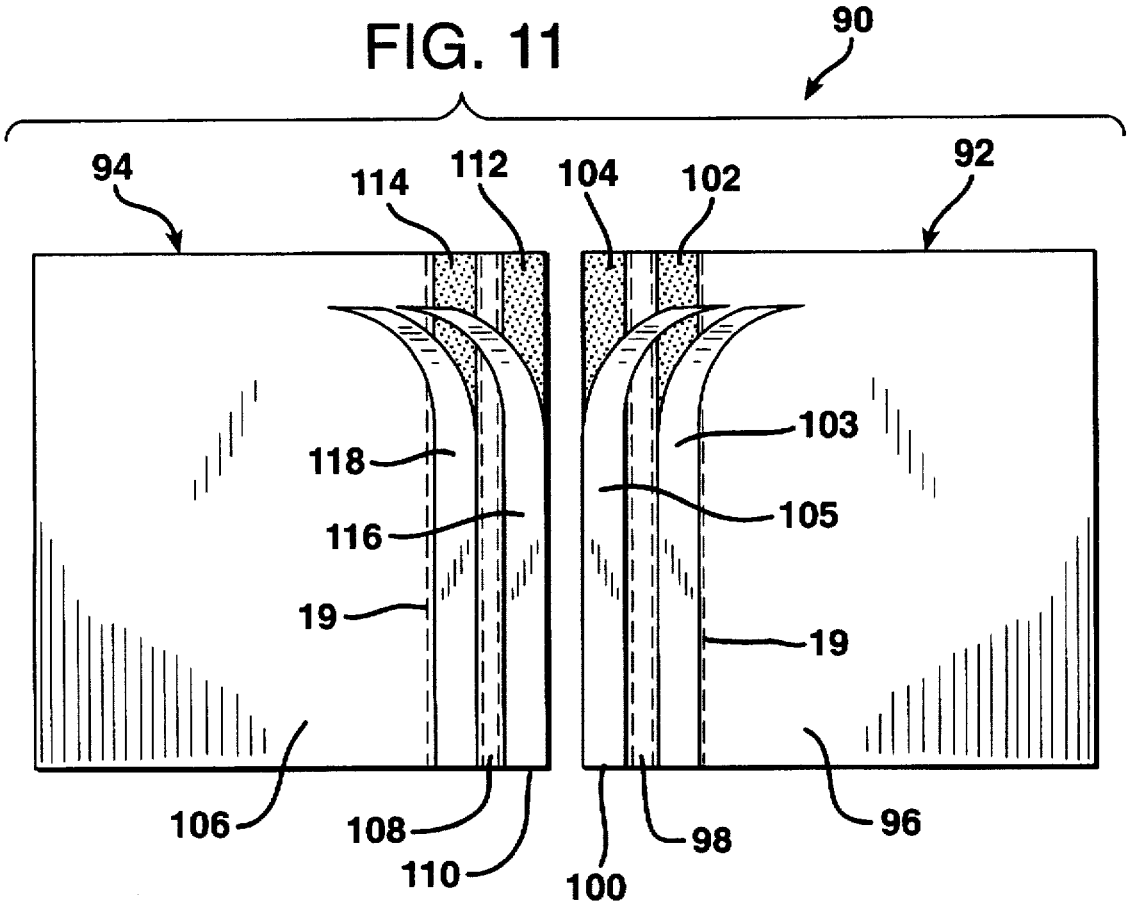
FIG. 11 is a top plan view illustrating two sheets of stock utilized to form a report cover for yet another embodiment of the invention.
Figure 13:
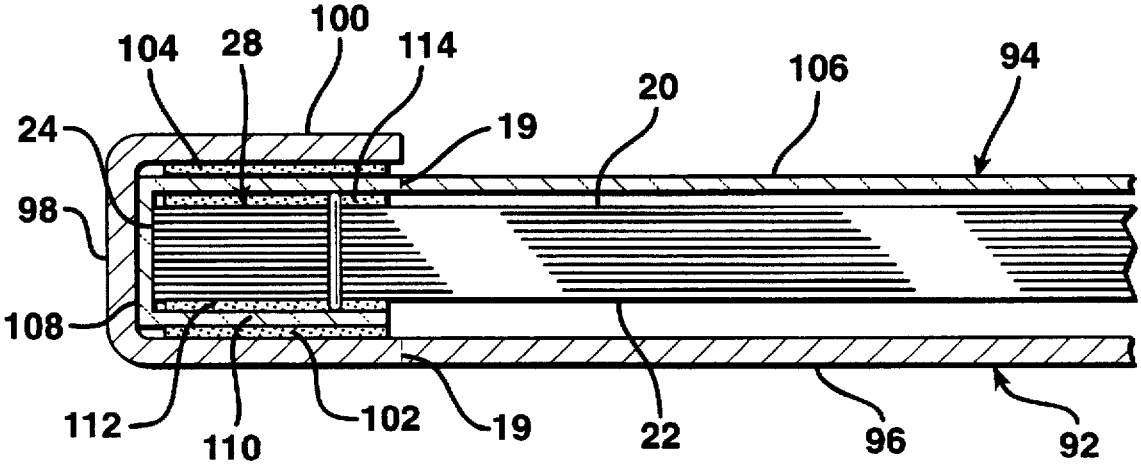
FIG. 13 is a sectional elevational detail illustrating the finished report of FIG. 12.
Figure 12:
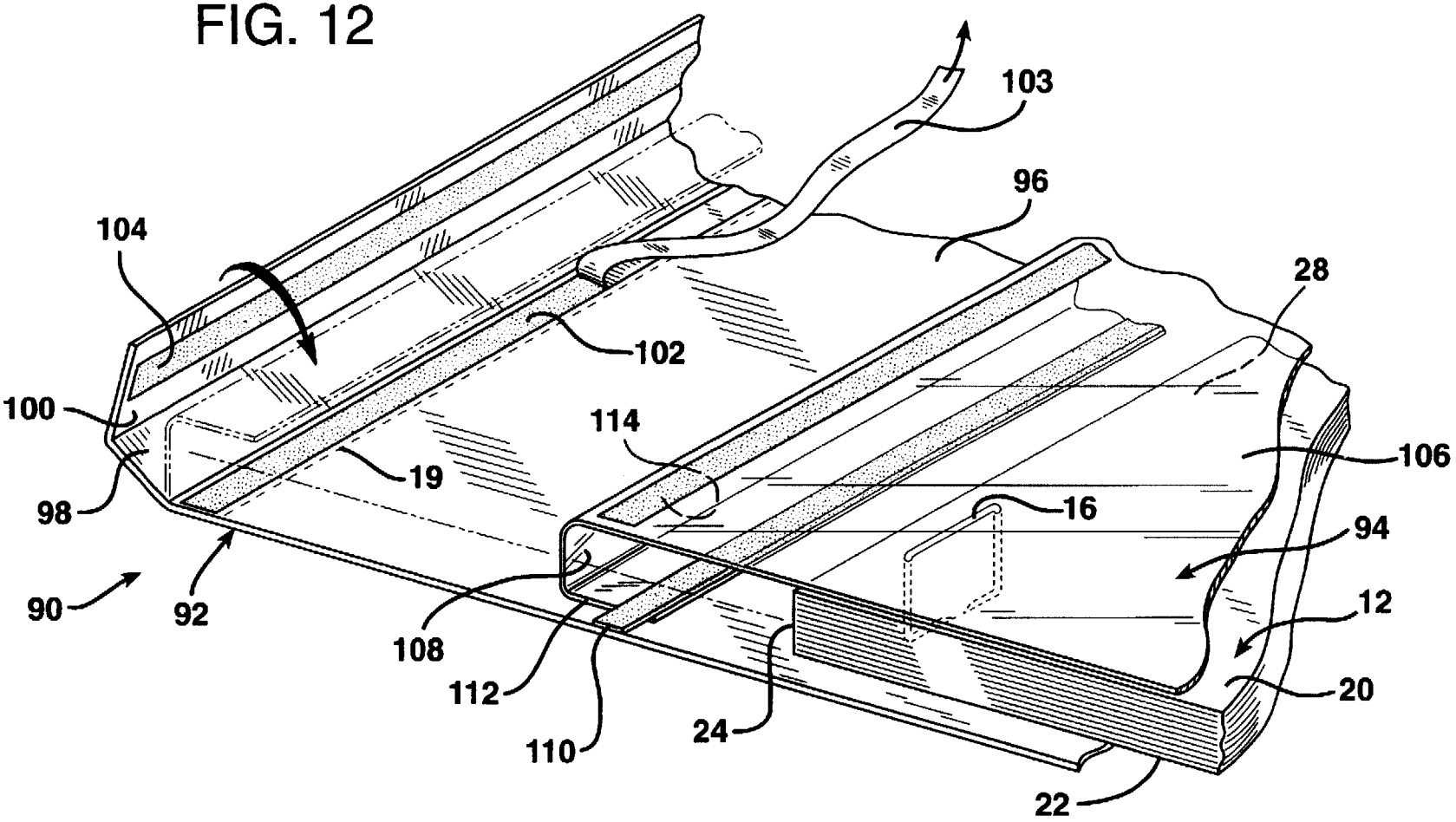
FIG. 12 is a perspective detail illustrating assembly of a report utilizing the report cover of FIG. 11.

Still a further embodiment of the invention is depicted in FIGS. 11, 12, and 13. The combination of a report cover, stack of papers, fasteners, and adhesive layers is depicted in these drawing figures.

The report cover 90 depicted in FIG. 11 is comprised of a single, folded, opaque, rectangular sheet 92 of card stock material and a single, folded, rectangular sheet 94 of transparent plastic material. The card stock sheet 92 forms a back cover panel 96, an outer spine panel 98, and a top concealment panel 100. The transparent sheet 94 forms a top cover panel 106, an inner spine panel 108, and a bottom shielding panel 110. In the finished article of manufacture, both of the sheets 92 and 94 are folded into generally J-shaped configurations, as best depicted in FIGS. 12 and 13.

The marginal edge of the back cover panel 96 is coated with a first layer of adhesive 102 of a width equal to the width of the binding margin 28 of the stack 12. Likewise, the top concealment panel 100 is covered with a second layer 104 of pressure-sensitive adhesive. The top concealment panel 100 has a width substantially equal to the width of the binding margin 28 of the stack 12.

The transparent sheet 94 defines along one of its edges a bottom shielding panel 110 covered by a third layer of adhesive 112. The bottom shielding panel 110 is substantially equal in width to the binding margin 28 of the stack 12. Immediately adjacent to the bottom shielding panel 110, the transparent sheet 94 defines an inner spine panel 108 that is slightly narrower in width than the outer spine panel 98 of the folded, opaque sheet 92. Immediately adjacent to the inner spine panel 108 the adjoining margin of the top cover panel cover 106 is coated with a fourth layer 114 of pressure-sensitive adhesive. The adhesive layer 114 is also substantially equal in width to the binding margin 28 of the stack 12.

The adhesive layers 102 and 104 are initially covered by narrow, release-coated strips 103 and 105, respectively, to prevent the adhesive layers 102 and 104 from bonding with any other structure until the report is to be assembled. Likewise, the adhesive layers 112 and 114 of the transparent sheet 94 are initially covered by release coated strips 116 and 118, respectively.

To assemble the report of FIGS. 11–13, the stack 12 of rectangular sheets of paper of uniform size are assembled together in the manner previously described and stapled together in the binding margin 28 thereof using three staples 16. The backs of the staples 16 project from and reside in direct contract with the top sheet 20 of the stack 12, while the legs of the staples project entirely through all of the sheets in the stack 12 and are crimped underneath and reside in direct contact with the bottom sheet 22 in the binding margin 28.

The release strip 118 is then removed from the adhesive layer 114 on the transparent sheet 94 and the top cover panel 106 is positioned atop the stack 12 such that the top cover panel 106 extends slightly beyond the edge 26 opposite the binding edge 24 of the stack 12, and such that the adhesive layer 114 resides against the binding margin 28 in direct contact with the top sheet 20 in the stack 12 immediately adjacent to the binding edge 24 of the stack 12.

The release strip 116 is then removed from the adhesive layer 112 and the inner spine panel 108 and the bottom shielding panel 110 are thereupon folded around the binding edge 24 of the stack 12, thereby bringing the adhesive layer 112 up against the underside of the bottom sheet 22 and against the binding margin 28 of the stack 12.

At this point in the assembly the staples 16 are shielded from contact with any external structure, but are still visible since the sheet 94 is formed of a transparent, plastic material. Once the transparent sheet 94 has been folded over the binding edge 24 of the stack 12 and the adhesive layers 112 and 114 thereof are respectively securely bonded to the bottom sheet 22 and top sheet 20 of the stack 12 at the binding margin 28 thereof, the release strip 103 is then removed from the narrow, marginal region of the back cover panel 96 adjacent the outer spine panel 98, thereby exposing the adhesive layer 102. The opaque sheet 92 is positioned so that the adhesive layer 102 adjacent the fold line 19 resides beneath and in alignment with the binding margin 28 of the stack 12. The stack 12 with the folded sheet 94 thereon wrapped over the binding edge 24 is then pressed downwardly to establish contact between the adhesive layer 102 and the exposed, uncoated side of the bottom shielding panel 110. The outer spine panel 98 may be folded up away from the back cover panel 96 to facilitate placement in this regard, as shown in FIG. 12.

Once the adhesive layer 102 has adhered to the surface of the bottom shielding panel 110 with which it resides in contact, the release strip 105 is then removed from the top concealment panel 100. The outer spine panel 98 is then folded at right angles up from the bottom cover panel 96, and the top concealment panel 100 is then folded over at right angles relative to the outer spine panel 98. This brings the adhesive layer 104 into direct contact with the region of the top cover panel 106 directly above the binding margin 28 of the stack 12.

Assembly of the report is thereupon completed, as depicted in FIG. 13. In this arrangement the regions of the top cover panel 106 and the bottom shielding panel 110 that cover the binding margin 28 of the stack 12 prevent contact of the staples with any external structure. The back cover panel 96 and the top concealment panel 100 of the folded opaque sheet 92 visually conceal the staples 16 from view.

In all of the embodiments of the reports or other documents illustrated in the drawings, the fasteners employed to secure the pages of the stack 12 together are totally shielded both from contact with any external structure, and also from external observation. The fasteners are thereby totally encased within the document cover.

Undoubtedly, numerous variations and modifications of the invention will become readily apparent to those familiar with office supply products. For example, the structure of the invention may be simplified by concealing and shielding only the portions of the fasteners that would otherwise be visible and accessible from the top of the stack 12. In this connection one could dispense with the adhesive layer 18 in the embodiment of FIGS. 8–10 and with the adhesive layers 102 and 112 in the embodiment of FIGS. 11–13. In such an arrangement the bent extremities of the legs of the staples 16 would only be shielded from contact and from view when the report is totally closed, but would be visible if the top cover panel of the report and the stack 12 were folded entirely away from the back cover panel. Also, one could substitute one or more pronged fasteners for the staples depicted in the embodiments illustrated. Accordingly, the scope of the invention should not be construed as limited to this specific embodiments illustrated and described.

I claim:

1. In combination, a plurality of pages disposed one atop another to form a stack with top and bottom sheets and defining a binding edge of said stack, an opposite edge of said stack parallel to said binding edge, and a narrow binding margin on said stack adjacent to said binding edge, a document cover formed of a plurality of panels including a broad top cover panel located atop said stack and extending across said stack from at least said binding margin and reaching said opposite edge, at least one concealment panel attached to said top cover panel atop said binding margin and extending across said narrow binding margin to said binding edge, and a broad back panel joined to said concealment panel by at least one spine fold adjacent said binding edge so as to extend beneath said stack and so as to reach said opposite edge, at least one fastener passing through and emerging from said top and bottom sheets at said binding margin of said stack, and at least one layer of adhesive interposed between said document cover and said narrow binding margin of said stack to thereby conceal said at least one fastener from view where it emerges from at least said top sheet.

2. A combination according to claim 1 wherein said broad top cover panel resides in contact with said binding margin and extends to said binding edge.

3. A combination according to claim 2 wherein said at least one adhesive layer adhesively bonds said top cover panel directly to said concealment panel.

4. A combination according to claim 3 wherein said at least one fastener also emerges from said top cover panel above said binding margin as well as from said top sheet in said stack, and said at least one concealment panel covers a portion of said top cover panel above said binding margin.

5. A combination according to claim 1 further comprising a pair of adhesive layers as aforesaid, one of said adhesive layers being interposed between said at least one concealment panel and said top sheet and the other of said adhesive layers being interposed between said back panel and said bottom sheet.

6. A combination according to claim 1 further comprising a spine panel located adjacent to said binding edge in an orientation perpendicular to said sheets, and joined to said concealment panel by a first spine fold and to said back panel by a second spine fold.

7. A combination according to claim 1 wherein said document cover is formed from a plurality of sheets of planar stock including at least one transparent plastic sheet and at least one opaque sheet, and wherein said top cover panel is formed by said transparent plastic sheet and said back panel and said concealment panel are both formed by said at least one opaque sheet of stock.

8. A combination according to claim 1 wherein said document cover is formed from a single sheet of planar stock.

9. A combination according to claim 8 further comprising a return panel located in articulated fashion between said concealment panel and said top cover panel.

10. A combination according to claim 9 further comprising a second layer of adhesive interposed between said back panel and said bottom sheet.

11. A combination according to claim 1 further comprising a plurality of fasteners as aforesaid.

12. A combination according to claim 11 wherein said fasteners are wire staples.

13. In combination, a plurality of sheets of paper disposed one atop another to form a stack with top and bottom sheets and defining a binding edge of said stack, an opposite edge parallel to said binding edge, and a narrow binding margin on said stack adjacent to said binding edge, a document cover formed of a plurality of panels including a broad top cover panel located atop said stack and residing in contact with said binding margin and extending entirely across said stack from said binding edge and reaching said opposite edge, a narrow return panel joined to said top cover panel and extending from said top cover panel at said binding edge above said narrow binding margin, a top concealment panel folded from said return panel back across said binding margin to at least said binding edge, and a back panel joined to said return panel by at least one spine fold so as to extend beneath said stack to reach said opposite edge, at least one fastener passing through and emerging from said top and bottom sheets at said binding margin of said stack and through said top cover panel where it contacts said binding margin and is covered by said concealment panel, and at least one layer of adhesive interposed between said stack and said document cover to hold said top concealment panel atop said binding margin of said stack.

14. A combination according to claim 13 wherein said at least one layer of adhesive includes a bottom layer of adhesive interposed between said back panel and said bottom sheet.

15. A combination according to claim 13 further comprising a plurality of fasteners as aforesaid, and said fasteners are formed as wire staples.

16. In combination, a plurality of sheets of paper disposed one atop another to form a stack with top and bottom sheets and defining a binding edge of said stack, an opposite edge of said stack parallel to said binding edge, and a narrow binding margin on said stack adjacent to said binding edge;

a document cover formed of a plurality of panels including a broad top cover panel located atop said stack and residing in contact with said top sheet at said binding margin and reaching said opposite edge of said stack, a narrow bottom shielding panel attached to said top cover panel by at least one spine fold and extending from said binding edge across said narrow binding margin and in contact with said bottom sheet beneath said stack, a broad back panel located beneath said stack and residing in contact with said binding margin and reaching said opposite edge, and a narrow top concealment panel attached to said back panel by at least one spine fold and extending from said binding edge across the portion of said top cover panel located atop said binding margin;

at least one fastener passing through said top and bottom sheets and emerging from said stack at said binding margin of said stack; and a top layer of adhesive interposed between said top concealment panel and said top cover panel and a bottom layer of adhesive interposed between said bottom shielding panel and back panel, whereby said concealment and shielding panels totally encase said at least one fastener from view.

17. A combination according to claim 16 further comprising at least an outer spine panel located in articulated fashion between said back panel and said top concealment panel.

18. A combination according to claim 17 further comprising an inner spine panel located in articulated fashion between said top cover panel and said bottom shielding panel.

19. A combination according to claim 16 wherein said top cover panel and said bottom shielding panel are fabricated from a single folded sheet of transparent stock and said back panel and said top concealment panel are fabricated from a single folded sheet of opaque stock.

* * * * *